United States Patent [19]

Vereb

[11] 4,032,005

[45] June 28, 1977

[54] DISPLAY CONTAINERS

[75] Inventor: William J. Vereb, Ringwood, N.J.

[73] Assignee: J. & P. B. Myers Inc., Moonachie, N.J.

[22] Filed: Oct. 22, 1975

[21] Appl. No.: 624,594

[52] U.S. Cl. ..... 206/45.14; 206/45.34; 206/277; 206/362.4; 229/8

[51] Int. Cl.[2] ..... B65D 5/08; B65D 25/54

[58] Field of Search ..... 229/8; 206/45.14, 45.19, 206/45.31, 45.34, 277, 361, 362.4, 491

[56] References Cited

UNITED STATES PATENTS

| | | | |
|---|---|---|---|
| 2,727,620 | 12/1955 | Buttery | 206/45.19 |
| 2,946,433 | 7/1960 | Hennessey | 206/45.19 |
| 3,010,571 | 11/1961 | Transport | 229/8 |
| 3,089,590 | 5/1963 | Mell | 229/8 |
| 3,190,440 | 6/1965 | Palmer | 206/45.31 |
| 3,254,759 | 6/1966 | Britton | 206/45.31 |
| 3,424,380 | 1/1969 | Curran | 206/45.34 |
| 3,486,615 | 12/1969 | Woskin | 206/45.34 |
| 3,637,130 | 1/1972 | Farquhar | 229/8 |
| 3,682,298 | 8/1972 | Guillerm | 206/45.31 |

*Primary Examiner*—William Price
*Assistant Examiner*—Bruce H. Bernstein

[57] ABSTRACT

Containers are disclosed in which a transparent front wall is joined along lateral margins to a rear wall, which is formed of front and back panels adhered together and arranged to be stored flat. The rear wall has transversely elongated flaps of curved outline that cause the front and rear walls of the container to bow away from each other when the flaps are erected, the erected flaps forming end closures of the container. The panels of the rear wall provide article-engaging formations for fixing the location of an article or articles in the container, and to enable the container to be stood upright or to be hung on a rod for display purposes.

19 Claims, 10 Drawing Figures

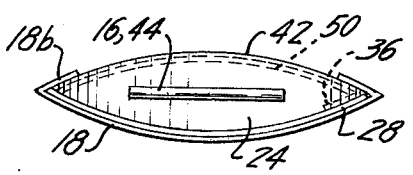
FIG.3
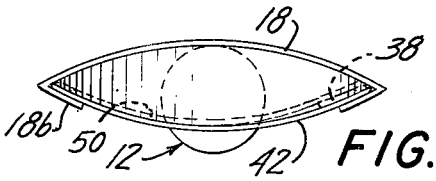
FIG.4
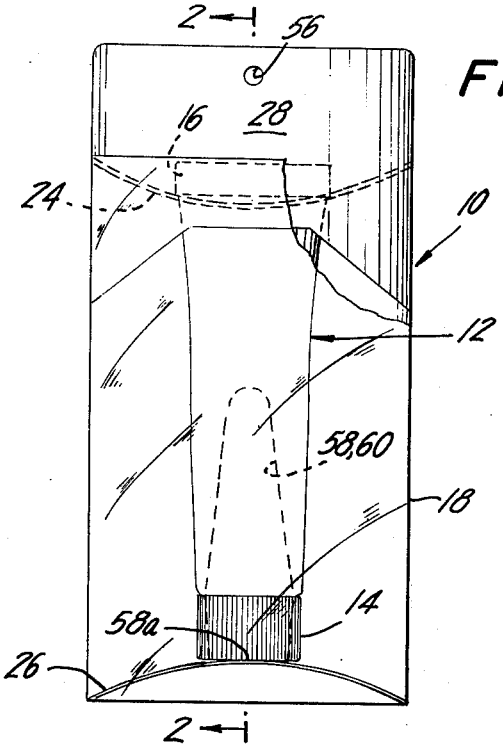
FIG.1
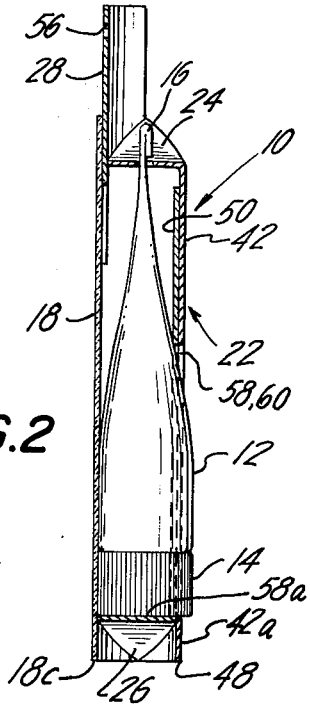
FIG.2
FIG.5
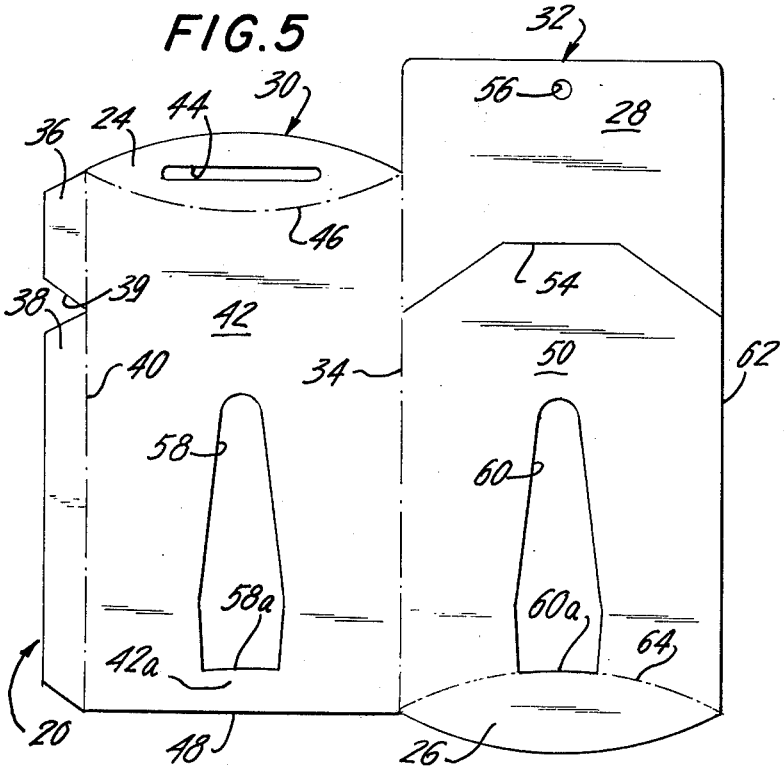
FIG.7
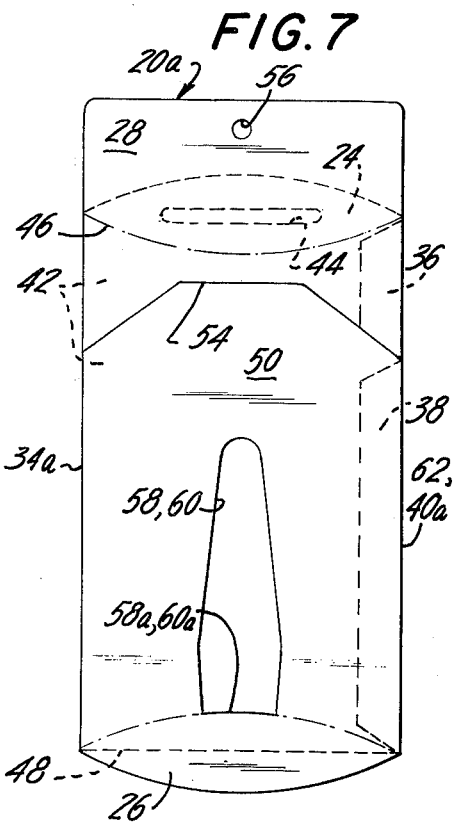

FIG. 6
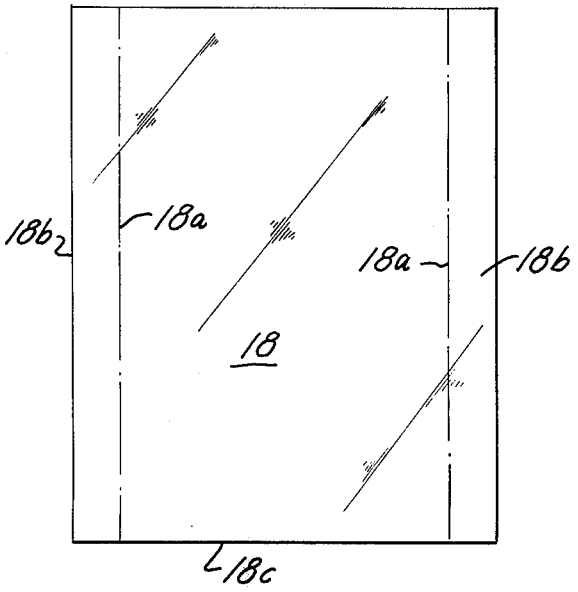
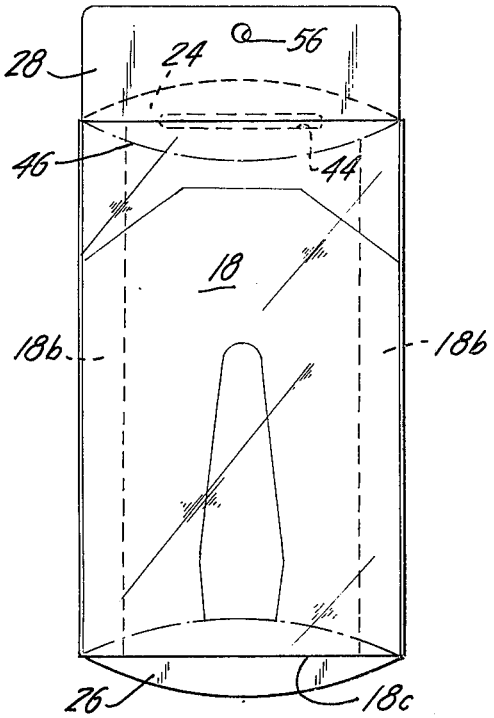
FIG. 8
FIG. 9
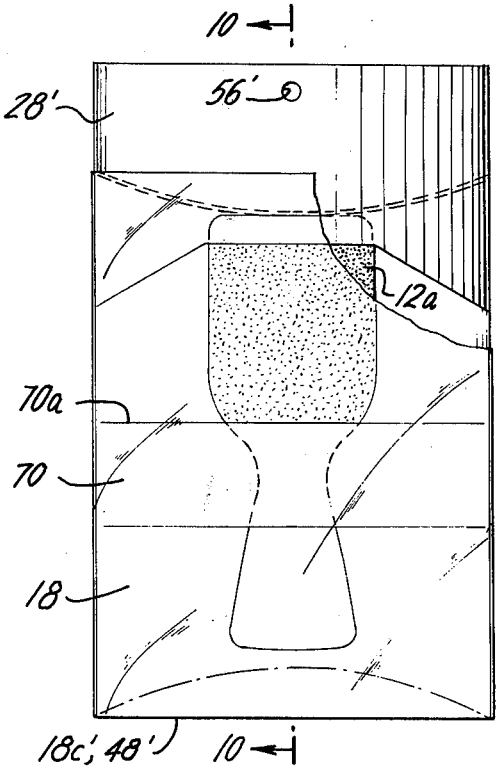
FIG. 10
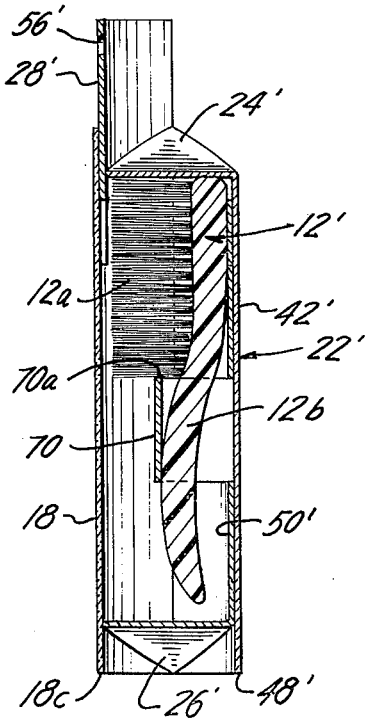

DISPLAY CONTAINERS

FIELD OF THE INVENTION

This invention relates to containers for effective display of an enclosed article.

BACKGROUND OF THE INVENTION

The background of the present invention is not amenable to any brief summary, since any discussion of this kind would depend on whatever starting point might be chosen. Containers of various forms are known having a transparent cover for displaying a contained article. Flaps of "lenticular" outline have been used to bow the walls of the container away from each other and to form end closures of the container. the term "lenticular" is used here to refer to a shape formed by two intersecting arcs that bow away from each other (like the cross-section of a double convex lens) and equivalent shapes.

SUMMARY OF THE INVENTION

The presently preferred embodiments of the invention disclosed in detail below have a transparent dimensionally stable front wall and a double-panel rear wall that bears lenticular-outline flaps, plus means provided by or taken from the panels of the back wall to support and fix the location of an article in the container formed of said front and back walls and said flaps when erected to constitute closures.

The container conventionally has a hole in a wall, near the rop of the container, so it can be hung on a display rod; and in addition the lower edge of the transparent front wall and the lower edge of at least one of the panels forming the back wall are transversely aligned and enable the container to be stood upright for display purposes.

The panels are held together between their lateral margins as by adhesive so that there is no tendency of the front panel of the rear wall becoming bowed forward when the back panel becomes bowed backward. The panels are parts of a single sheet of carboard or like sheet material having a finish on one side, so that the finish is exposed at the front and at the rear of the rear wall; and because the two panels are part of one sheet, they are inherently held in proper relationship when folded against each other about a preformed fold line.

The front panel has a top portion forming a display panel, and a top closure of lenticular shape is joined by a crease to the back panel behind the display panel. When erected, the top closure presses the display panel against the inside surface of the bowed transparent front wall; and the display panel acts, in turn, to conceal the top closure.

The nature of the invention will be more fully understood and appreciated from the following detailed description of the presently preferred illustrative embodiment and a modification, and from the appended claims. The illustrative embodiments are shown in the accompanying drawing forming part of the disclosure of the invention. In the following detailed description, the foregoing novel features are described and additional novel features are noted. It is evident that certain of the novel features may be used to advantage without others, and that a range of variation and varied application of the novel features will occur to those of ordinary skill in the art.

DESCRIPTION OF THE DRAWINGS

FIG. 1 is the front elevation of a package consisting of a container and an article therein, as an illustrative embodiment of various features of the invention;

FIG. 2 is a vertical cross-section of the container of FIG. 1 at the plane 2—2 in FIG. 1, including a side elevation of the article;

FIGS. 3 and 4 are top and bottom plan views, respectively, of the embodiment of FIG. 1;

FIG. 5 is a front elevation of a sheet in flat condition, to become the back wall and other parts of the container of FIG. 1;

FIG. 6 is a front elevation of a sheet to form the front wall of the container of FIG. 1;

FIG. 7 is a fron elevation of the sheet of FIG. 5, folded and in condition for assembly to the sheet shown in FIG. 6;

FIG. 8 is a front elevation of the container of FIG. 1, flat and in condition for storage;

FIG. 9 is the front view of a package consisting of a container and a hair brush, as a modification of the embodiment in FIGS. 1–8; and FIG. 10 is a vertical cross-section of the package of FIG. 9.

DESCRIPTION OF ILLUSTRATIVE EMBODIMENTS

In FIG. 1, container 10 encloses article 12, being a tube of fluid in this instance. Tube 12 includes a screw cap 14 at one end, and it is closed by a "crimp" 16 at the other end. The tube is cylindrical near cap 14, and it tapers and becomes flat toward crimp 16.

Container 10 is formed of two parts, a transparent front wall 18 and a sheet 20 (FIG. 5). Sheet 20 constitutes a rear wall 22, top closure 24, bottom closure 26 and display panel 28 of the container, plus other parts.

Sheet 20 of cardboard or like material (FIG. 5) is divided into panels 30 and 32 by a fold line or crease 34. Flaps 36 and 38 are divided by cut 39, and are joined to main portion 42 of panel 30 by crease or fold line 40. A flap 24 forms the top closure of container 10. Flap 24 has a lenticular outline consisting of two intersecting circular arcs. An elongated hole 44 extends along flap 24, being an aperture that is to receive the flattened end portion of tube 12 near crimp 16. Flap 24 is joined to main portion 42 of panel 30 by a crease 46, this crease and the free edge of flap 24 defining its lenticular shape. As is apparent, elongated flap 24 is transverse to parallel creases 34 and 40. Panel 30 has a straight edge 48 transverse to creases 34 and 40.

Panel 32, divided from panel 30 by crease 34, is as wide as panel 30. Actually, panel 32 consists of a main panel portion 50, a flap 26, and a display panel 28. panel portion 50 and display panel 28 are separated by a die cut 54. A hole 56 in display panel 28 enables the package to be hung on a merchandise display rod.

Holes 58 and 60 are cut in panel portions 42 and 50, in position to move into registry when sheet 20 is folded about crease 34 as shown in FIG. 7. Apertures 58 and 60 are of the same shape, for promoting an attractive appearance of the package when viewed from the front and from its rear. Bottom portion **58*a* of aperture 58 extends transverse to fold lines 34 and 40, and defines an edge portion 42*a* constituting a shoulder that supports tube 12. (FIGS. 1 and 2.) Aperture 60 includes an aperture portion 60*a* that becomes aligned with aperture portion 58*a* when the sheet is folded. Both aperture portions 58***a* and 60*a* may be straight or they may both be curved, or they may have any other suitable shape or different shapes. Bottom flap 26 has a lenticular outline and is the same size as flap 24, and its length extends transverse to fold line 34 and edge 62. The free edge of flap 26 and the opposite part of its outline consisting of crease 64 interrupted by aperture portion 60*a* are circular arcs.

In a preparatory operation, sheet 20 is folded so that main panel portion 50 overlies most of main panel portion 42, and so that flaps 36 and 38 are covered by display panel 28 and panel portion 50, respectively. Panel portion 42 extends well above die cut 54, so that flap 24 is behind display panel 28. Adhesive unites flaps 36 and 38 to display panel 28 and panel portion 50, respectively; and adhesive also unites main portion 50 of panel 32 to main panel portion 42 of panel 30.

The exposed surface of panel portion 50, the exposed surface of display panel 28, and the oppositely exposed surface of panel portion 42 are all extensions of the same original surface of sheet 20. Consequently, only one surface of sheet 20 is provided with an attractive finish, the finish that will be exposed to view in the completed container. As examples of this finish, it may be very thin lamination of aluminum, glazed paper or other attractive material, or it may be a prepared surface finish of the cardboard itself, where cardboard is used. When sheet 20 is folded to form part 20*a*, the finished surfaces face outward, and the parts of panels 30 and 32 become properly related to each other without need of special equipment for registering separate panels, were panels 30 and 32 formed as separate parts.

Edge 62 is aligned with fold 40*a*, forming one lateral margin of the cardboard part 20*a* resulting from folding and gluing sheet 20. The opposite lateral margin of part 20*a* is formed at fold 34*a*. Sheet 18 (FIG. 6) is made of dimensionally stable, resilient transparent plastic material, and is creased along lines 18*a* to form flaps 18*b*. Creases 18*a* are separated slightly farther apart than lateral margins 34*a* and 40*a* of part 20*a*. Sheet 18 is assembled to part 20*a* and flaps 18*b* are bent around and adhered to the rear of part 20*a*, for example using heat-activated cement. Folds 34*a* and 40*a* are parallel, as are folds 18*a*, where the design of the package calls for parallel edges. Were the package tapered, the margins would be related accordingly.

The finished container is flat, in condition for compact storage as shown in FIG. 8. When a tube is to be inserted, flap 24 may be erected to its position in FIG. 2. In this condition, flap 24 presses display panel 28 forward, against part of transparent front wall 18 of the container. (The location of the upper edge of sheet 18 may be varied, of course, relative to the top of panel 28.) The tube 12 may then be dropped into place, with its crimped and flattened end portion protruding through hole 44 in top closure 24. Then bottom closure 26 may be erected. Tube 12 protrudes through aperture(s) 58, 60, and cap 14 rests on portion 42*a* of back panel 42. The back wall 22 of the package consists of a front panel portion 50 and a back panel portion 42. When flap 24 is erected, it causes the front and back walls to become oppositely bowed. Because of the adhesive uniting panel portions 42 and 50, there is no tendency of the front panel portion to bow forward, with wall 18.

The lower edge 18*c* of the transparent front wall 18 and the lower edge 48 of the back panel portion 42 are aligned and they are transverse to the parallel (or other) margins of the container. Edges 18*c* and 48 thus enable the package to be stood upright, for display purposes. The lenticular-outline closures 24 and 26 impart an attractive curved form to the container, and because they are arched when erect (see FIG. 1) they form stable end closures. However, there is no danger of the tube forcing bottom closure 26 out of position by its weight or due to impact in handling, because cap 14 bears against shoulder or edge portion 42*a* of the rear wall.

Tube 12 is retained in the desired position by the lateral edges of aperture 58, 60 in the rear wall 22 of the container, by shoulder 42*a*, and by the edges of hole 44 that positively prevent tilting of the tube.

The double-panel construction of the rear wall 22 has various advantages in this embodiment. At the bottom, lenticular-shaped flat 26 is provided by the front panel while the back panel provides tube supporting shoulder 42*a* and container supporting edge 44. The panel that provides front panel portion 50 also provides display panel 28 that is decorative and conceals top closure 24 and crimp 16 of the tube. Flap 24 is joined by a crease to the back panel portion 42 of the rear wall. Flap 36 of panel portion 42 is adhered to the margin of display panel 28 remote from fold 34*a*, imparting stability to display panel 28 and imparting the strength required when the package is hung on a merchandise display rod.

Cap 14 of tube 12 seems to bear against bottom closure 26 whereas (as earlier noted) the stress of the contained article against bottom closure is absorbed by shoulder 42*a* aligned with the bottom closure. Further, both panels forming the rear wall of the container have openings allowing the article to protrude, for the purpose of orienting the article in the container. FIGS. 9 and 10 illustrate further aspects of the invention in these respects. Primed numerals are used for parts in FIGS. 9 and 10 corresponding to those of FIGS. 1–8, whose description is not repeated.

In FIGS. 9 and 10, a hair brush 12′ replaces tube 12 of FIGS. 1–4. Brush 12′ has projecting bristles 12*a* and a back 12*b* of molded plastic which provides a projecting handle and in which the bristles 12*a* are securely received. Back wall 22′ of the container in intact, in that it has no through holes. A strip 70 is cut from front panel portion 50′, capturing the brush handle against the back wall and providing a shoulder 70*a* for engaging the bristles to relieve the bottom closure 26′ of opening stress that could otherwise be applied by the weight of the brush, or in case of a jolt.

In the illustrative containers described above, the panels of the back wall are utilized to provide article-locating and supporting formations, but it will be recognized that varied forms of such formations and additional formations will be found useful. It is evident that some of the novel aspects of the invention as pointed out above in the summary of the invention and supplemented in the course of the description of the illustrative embodiments will be useful without others, and it is also evident that variation and varied applications of those novel features will be obvious to those skilled in the art. Consequently, the invention should be construed broadly in accordance with its full spirit and scope.

What is claimed is:

1. An article-display container adapted to be flat when stored and to become expanded for containing an article, including a back wall of dimensionally stable sheet material, a front panel of dimensionally stable transparent material, said back wall and said front panel being of substantially equal width and having lateral margins substantially aligned with each other so that the container can be flat for storage, said front panel having bent-over portions united to said back wall along said lateral margins of the latter, said sheet material including lenticular-shaped flaps defined by outwardly bowed arcs intersecting at said lateral margins, said flaps being joined to other portions of said sheet material by creases extending along respective ones of said arcs, means including said flaps when erected from said other portions of said sheet material end closures of the container and for bowing said back wall and said front panel apart for providing an article-containing space, said sheet material including a display panel having lateral margins aligned with the aforesaid lateral margins, at least part of the display panel being disposed behind said front panel in position to be bowed forward against the front panel by said flap when erected.

2. An article-display container as in claim 1 wherein said back wall includes a pair of panels of said sheet material disposed against each other and united to each other by a fold along one of said lateral margins, said sheet material having a distinctive finish at one side and said finish being exposed rearward and forward.

3. An article-display container as in claim 1 wherein said rear wall has portions defining an aperture for receiving a portion of an article in the container and for providing article-locating constraint against shifting of the article in the container.

4. An article-display container as in claim 1 wherein said back wall and said front panel have aligned edges transverse to said lateral margins for enabling the container to be stood erect on a supporting surface.

5. An article-display container adapted to be flat when stored and to become expanded for containing an article, including a first member of transparent dimensionally stable material, a second member of dimensionally stable material, said members being of equal width and having lateral margins substantially aligned with each other, said first member having lateral marginal folded-over portions united to said second member, said first and second members having portions providing front and rear wall portions of the container, and a further part of said second member constituting a display panel, said display panel extending between said lateral margins and being disposed behind at least a portion of said first member, parts of said second member forming lenticular-shaped flaps defined by oppositely bowed arcs intersecting at the ends of the flaps, said flaps being divided by creases along respective ones of said arcs from other portions of said second member and means including said flaps when erected for bowing said front and rear portions of the container apart, for forming end closures of the container and for press said display panel forward against said transparent first member.

6. An article-display container as in claim 5 wherein said part of the second member constituting the display panel and said part of the second member providing the rear wall portion of the container are parts of a piece of material having a distinctive finish on one side thereof, said distinctive finish facing forward and toward said transparent first member.

7. An article-display container adapted to be flat for storage and to become expanded for containing an article, including resilient dimensionally stable front and rear walls, said front wall being transparent, the front and rear walls being united along lateral margins and being of equal width between said lateral margins so that the container can be flat for storage, said front and rear walls having transverse aligned bottom edges adapting the container to stand upright and said rear wall bearing having means including a flap of lenticular outline for bowing the front and rear walls apart and for constituting and end closure of the container, said container including front and back panels, portions of which constitute said rear wall and lie against each other both when the container is flat and when the front and rear walls are bowed apart, one of said panels providing said transverse bottom edge and the other of said panels providing said flap.

8. An article-display container in accordance with claim 7 wherein said front and back panels are a single integral sheet united along a fold, said sheet having a distinctive finish at one side which finish is exposed rearward and forward when said panel portions lie against each other as aforesaid.

9. An article-display container adapted to be flat when stored and to become expanded for containing an article, including a front wall of resilient dimensionally stable transparent plastic material, laterally aligned front and back panels having mutually overlying front and back wall portions adhered to each other and defining the rear wall of the container, said transparent front wall having bent-over lateral marginal portions adhered to lateral marginal portions of said rear wall, said front and rear walls having equal width between the lateral margins thereof and thus being adapted to be flattened against each other, and said rear wall have been rewritten as - - - having means for bowing the walls of the container away from each other and for forming end closures of the container, said means including first and second lenticular-shaped flaps each joined by an arcuate crease to said rear wall and adapted to be erected therefrom.

10. An article-display container in accordance with claim 9 wherein said back panel and said front wall panel have means comprising aligned bottom edges transverse to their lateral margins for standing the package upright when said front and rear walls are bowed away from each other by said lenticular-shaped flaps, and wherein one of said panels has a top portion having a hole therein for suspending the container on a display rod.

11. An article-display container in accordance with claim 9 wherein each of said flaps extends from a respective one of said panels.

12. An article-display container in accordance with claim 9 wherein at least one of said rear-wall panels has an edge portion extending transverse to said lateral margins to engage an article in the container for providing positive restraint against shifting of the article toward one of said end flaps.

13. An article-display package in accordance with claim 9 wherein said rear wall incorporates means for restraining an article in the container against shifting toward one of said end flaps, at least one of said panels having an article-orienting opening a marginal portion of which defines at least part of said article-restraining means.

14. An article-display container in accordance with claim 9 including article-locating apertures in said front and back panels defining edge portions of the panels for cooperation with a protruding portion of an article in the container, part of said edge portion of one of said panels constituting a shoulder extending transverse to said lateral margins of the front and rear walls, and part of the aperture in the other of said panels being aligned with said shoulder and extending along the arcuate crease joining one of said flaps to said other panel, whereby an article in the container which protrudes through said apertures seems to rest on said one flap when erected as one end closure of the container, but bears against said shoulder and is restrained thereby against deforming said one end closure.

15. An article-display container in accordance with claim 9 wherein said rear-wall panels have at least approximately aligned article-locating apertures through which an article in the container is to protrude, and wherein an article-locating aperture is formed in one of said flaps.

16. An article-display container in accordance with claim 9 wherein said front panel and said back panel each incorporates one of said flaps wherein said front panel includes a display panel portion opposite said flap of said back panel, said display panel being joined only at its lateral margins to said back panel, said display panel being thus adapted to be pressed against the transparent front wall of the container by the flap of said back panel when erected.

17. An article-display container in accordance with claim 9 wherein said front panel incorporates said first flap at its lower end and said back panel incorporates said second flap at its upper end, and wherein said panels incorporate aligned apertures including transverse portions aligned with the crease of said first flap so as to provide restraint for an article in the container that seems to be resting on said first flap, said transparent front wall and said back panel having aligned transverse edge portions for standing the container upright, and said front panel including a display panel opposite said second flap, said display panel being joined only at its lateral margins to said back panel and being thus adapted to be pressed against said transparent front wall by said second flap in position to conceal the latter.

18. An article-display container in accordance with claim 9 wherein said front panel has a portion thereof opposite an intact portion of the back panel adapted to be raised away from said rear wall for restraining an article in the container against shifting.

19. An article-display container in accordance with claim 9 wherein said back panel and said front wall have means comprising aligned bottom edges transverse to their lateral margins for standing the package upright when said front and rear walls are bowed away from each other by said lenticular-shaped flaps.

* * * * *